US005140766A

United States Patent [19]

Brooks

[11] Patent Number: 5,140,766

[45] Date of Patent: Aug. 25, 1992

[54] DRAW BAR FIREARM LOCK

[75] Inventor: Frank Brooks, Jupiter, Fla.

[73] Assignee: Saf T Lok Corporation, West Palm Beach, Fla.

[21] Appl. No.: 645,565

[22] Filed: Jan. 24, 1991

Related U.S. Application Data

[63] Continuation-in-part of Ser. No. 556,016, Jul. 20, 1990, Pat. No. 5,090,148, which is a continuation-in-part of Ser. No. 202,988, Jun. 6, 1988, Pat. No. 4,987,693.

[51] Int. Cl.[5] ..... F41A 17/04

[52] U.S. Cl. ..... 42/70.11

[58] Field of Search ..... 42/70.08, 70.11, 70.04, 42/70.05; 89/148

[56] References Cited

U.S. PATENT DOCUMENTS

| | | | |
|---|---|---|---|
| 804,694 | 11/1905 | Whiting | 89/148 |
| 2,803,910 | 8/1957 | Lyle | 42/70.11 |
| 2,846,925 | 8/1958 | Norman | 89/148 |
| 3,735,519 | 5/1973 | Fox | 42/70.01 |
| 3,757,634 | 9/1973 | Uria et al. | 89/148 |
| 3,939,679 | 2/1976 | Barker et al. | 42/70.11 |
| 4,003,152 | 1/1977 | Barker et al. | 42/70.11 |
| 4,014,123 | 3/1977 | Williams | 42/70.11 |
| 4,302,898 | 12/1981 | Larue | 42/70.11 |
| 4,306,487 | 12/1981 | Beretta | 89/148 |
| 4,457,091 | 7/1984 | Wallerstein | 42/70.11 |
| 4,488,370 | 12/1984 | Lemelson | 42/70.11 |
| 4,682,435 | 7/1987 | Heltzel | 42/70.11 |
| 4,763,431 | 8/1988 | Allan et al. | 42/70.11 |
| 4,987,693 | 1/1991 | Brooks | 42/70.11 |

OTHER PUBLICATIONS

Beretta dal 1526, Serie 81, Instructions for Operations, Sep. 1986.

Smith & Wesson, Revolvers, Safety & Instructions Manual, Apr. 1987.

Smith & Wesson, Semiautomatic Centerfire Pistols, Safety, Instruction & Parts Manual, Jun. 1988.

Shooting Times, Apr. 1973, "Is Your Safety Really Safe?", pp. 40–43 and 78.

*Primary Examiner*—Michael J. Carone

*Attorney, Agent, or Firm*—Quarles & Brady;

[57] ABSTRACT

A lock for a firearm is operable to engage and disengage a draw bar or trigger bar of the firearm, which connects the trigger to the hammer. The lock includes a lock member which, in the locked position, operatively engages the draw bar to move the draw bar out of engagement with the hammer. The firearm is thereby rendered inoperative. The lock member, in the unlocked position, permits the draw bar to engage the hammer in the usual manner to permit operation of the firearm. The lock member can be provided as part of a lock assembly which can be readily installed in the firearm, and in a construction which is resistant to tampering.

7 Claims, 4 Drawing Sheets

DRAW BAR FIREARM LOCK

CROSS REFERENCE TO RELATED APPLICATIONS

This application is a continuation-in-part of Applicant's co-pending application Ser. No. 556,016, now U.S. Pat. No. 5,090,148 filed Jul. 20, 1990, which is a continuation-in-part of Applicant's co-pending application Ser. No. 202,988, filed Jun. 6, 1988, now U.S. Pat. No. 4,987,693.

BACKGROUND OF THE INVENTION

1. Field of the Invention

This invention relates generally to firearm locks, and more particularly to firearm locks which are provided so as to be substantially integral with the firearm.

2. Description of the Prior Art

There is a continuing need to provide locks for firearms which will effectively prevent operation of the firearm by unauthorized users, but which are readily manipulated by authorized users to permit deactivation of the lock and operation of the firearm in an emergency. It is desirable that such a lock be easily installed and non-intrusive to the integrity of the firearm, such that continued reliability of the firearm is insured after installation of the lock. It is also desirable that such a lock be entirely integral with the firearm, such that the lock or a key for the lock cannot be misplaced or lost.

There have been many attempts to devise locks for firearms which will prevent unauthorized use of the firearm. These locks often are not integral with the firearm, and accordingly, must be removed in order to render the firearm operable, and can thereby be lost or misplaced. Prior locks for firearms which have been made to be integral with the firearm require extensive modification to the firearm, and thus can affect the reliability of the firearm and require time and expense for proper installation. These firearm locks are sometimes difficult to manipulate, and therefore can be dangerous in an emergency where quick operation of the firearm is necessary.

SUMMARY OF THE INVENTION

It is an object of the invention to prevent the operation of firearms by unauthorized users.

It is another object to the invention to provide a lock for firearms which is easily installed.

It is yet another object of the invention to provide a lock for firearms which is integral with the firearm and will preclude the possibility that the lock will be lost or misplaced.

It is another object of the invention to provide a lock for firearms which will not affect the reliability of the firearm.

It is still another object of the invention to provide a lock for firearms which can be readily deactivated to permit quick operation of the firearm in an emergency.

It is yet another object of the invention to provide a lock for firearms which can be installed in the firearm without extensive modification to the firearm.

These and other objects are accomplished by a lock for firearms of the type having a draw bar or trigger bar connection between the trigger and the hammer of the firearm. The draw bar is disengageable by operation of a lock assembly having a lock member which, in the locked position, operatively engages the draw bar to prevent engagement of the hammer by the draw bar.

The firearm will thereby be deactivated. The lock member, in an unlocked position, will permit engagement of the hammer by the draw bar in the usual manner, to permit operation of the firearm. Operation of the firearm will thereby be permitted only for authorized users who have the ability to unlock the lock.

The lock assembly is preferably installed in the handgun in a position substantially adjacent to the draw bar. The lock member is preferably provided with an abutment portion which abuts the draw bar. Movement of the lock member to the locked position will cause the abutment portion to move the draw bar to a position out of engagement with the hammer of the firearm. Movement of the lock member to the unlocked position will permit the draw bar to move back into engagement with the hammer and will permit operation of the firearm. Spring biasing can be provided to assist proper engagement of the hammer by the draw bar upon movement of the lock member to the unlocked position. The lock assembly can be provided in a lock housing and attached directly to the frame of the firearm, or alternatively can be installed in a handle grip adapted to replace an existing grip of the firearm.

The lock can be selected from a number of locks suitable for this purpose. Applicant has disclosed in Applicant's co-pending applications a variety of locks suitable for this purpose, although other locks would also be acceptable. It is preferred that keys and other external devices for unlocking the lock are avoided, as such are dangerous in an emergency where quick operation of the firearm is necessary. It is also preferred that the lock be operable without the necessity of seeing the lock, such that the lock can be unlocked in a dark environment. In a preferred embodiment, the lock comprises one or more push members, where each push me must be depressed a proper a number of times, or in a proper sequence, in order to open the lock.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
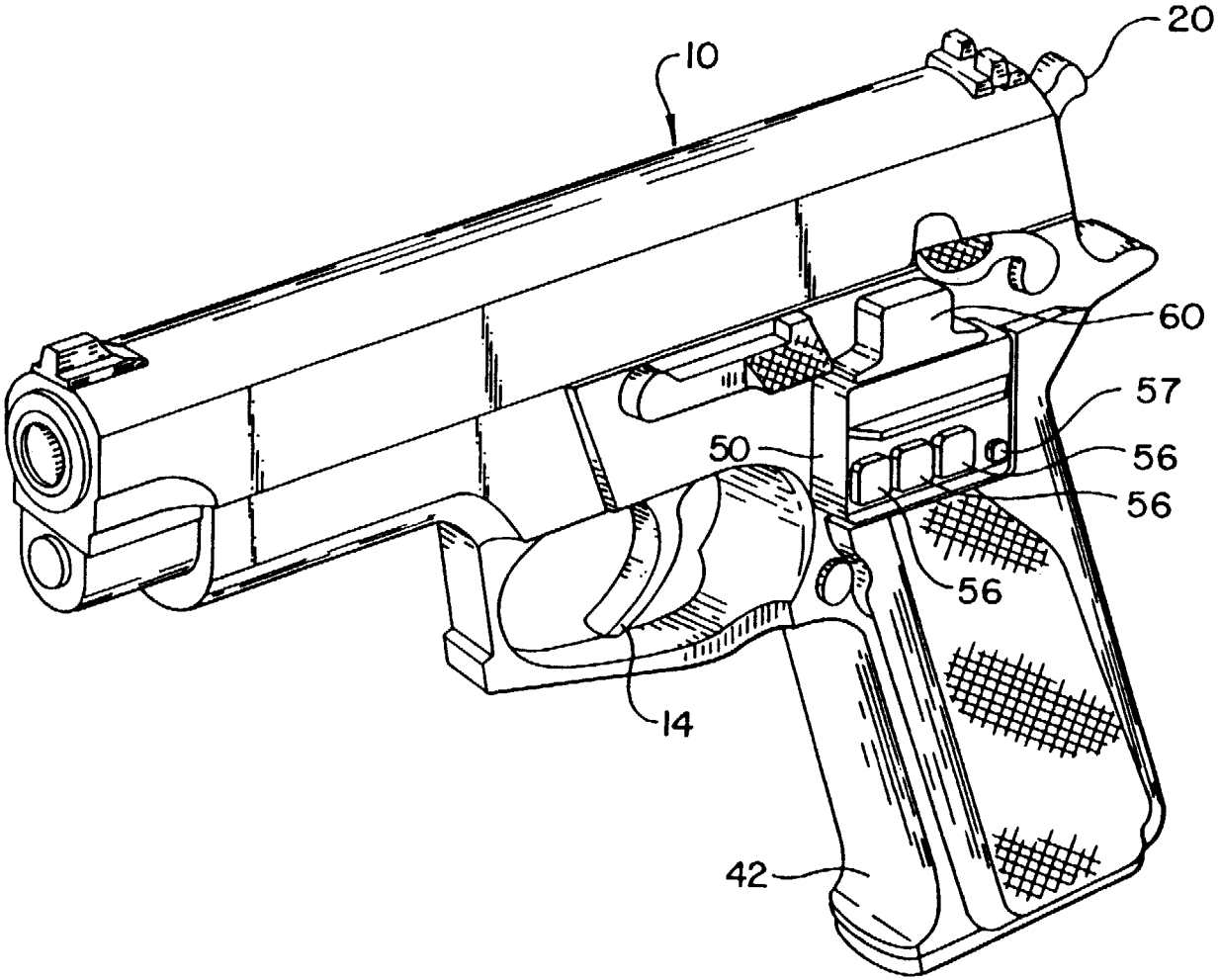
FIG. 1 is a perspective view of a firearm with a lock according to the invention.

The use of the invention will be described with reference to a Smith & Wesson semiautomatic centerfire pistol, manufactured by The Smith & Wesson Company of 2100 Roosevelt Avenue, Springfield, Mass. The weapon is fully described in the Safety Instruction & Parts Manual, distributed by the company, which manual hereby is fully incorporated by reference. The lock of the invention can also be used, with minor modification, in gun designs of many descriptions. The operation of most handguns is well understood, and described in several volumes including the Gun Digest Book of Firearms Assembly/Disassembly, Parts I and II; Automatic Pistols and Revolvers, by J.B. Wood, D.B.I. Books, Inc., Northbrook, Ill., 1979; The S&W Revolver, A Shop Manual, Jerry Kuhnhavsen, V.S.P. Publishers, Department 1A, Box 1966, Tusten, Calif. 92681; The Colt 45 Automatic, A Shop Manual, Jerry Kuhnhavsen, V.S.P. Publishers, Department 1A, Box 1966, Tusten, Calif. 92681; and the NRA Guide to Firearms Assembly, National Rifle Association of America, 1600 Rhode Island Avenue N.W., Washington, D.C. 20036. The disclosures of the above-identified references are hereby fully incorporated by reference.

There is shown in the drawings a firearm 10 which has a draw bar 22 connecting the trigger 14 and the hammer 20. The trigger 14 can be pivotally mounted about a mounting pin 26, and the hammer 20 can be pivotally mounted about a mounting pin 28. The operation of the draw bar is known in the art, in a variety of configurations, and the following explanation is intended only as an example. A draw bar engagement portion 30 of the trigger 14 is adapted to abut a trigger engagement portion 24 of the draw bar 22 when the trigger is operated. This action will move the draw bar 22 forward against the biasing of a return spring 38. A hammer engagement portion 32 of the draw bar 22 is adapted to engage a draw bar engagement portion 34 of the hammer 20, such that forward movement of the draw bar 22 will cause the hammer 20 to pivot about the pivotal mounting 28. The hammer 20 and draw bar 22 are configured in a manner known in the art such that the draw bar 22 will release the hammer 20 when the hammer 20 has rotated rearwardly to a pre-determined position. Spring biasing of the hammer is provided such that, in known fashion, the hammer 20 will rotate forward when released to strike the firing pin and fire the gun.

The draw bar 22 is provided in existing firearms as a safety which will prevent operation of the firearm when the magazine has been removed. The magazine fits into a shaft 40 in the handle frame 42 of the firearm, and is typically inserted through an opening in the base of the handle frame 42. In known fashion, removal of the magazine (not shown) from the handle frame 42 will permit the draw bar 22 to move out of engagement with the hammer 20, whereby operation of the trigger 14 will be ineffective to rotate the hammer 20 and operate the firearm. Accidental firing of the gun when the magazine has been removed is thereby prevented.

According to the invention, a lock is installed so as to be integral with the firearm. The lock has a draw bar engagement portion which is adapted to, in the locked position, move the draw bar 22 out of engagement with the hammer 20, whether or not the magazine of the firearm is in place. The lock assembly may be provided in a housing 50 as shown. Alternatively, the lock may be installed in a handle grip which replaces the existing handle grip of the firearm. This will facilitate the installation process and proper alignment with the draw bar 22. The lock assembly is mounted in a position of the firearm such that a draw bar engagement portion 54 of the lock will directly engage or substantially abut the draw bar 22. The draw bar engagement portion 54 can be provided in any configuration suitable for moving the draw bar 22 out of engagement with the hammer 20 when the lock is in the locked position.

The type of lock that is used can be selected from a number of suitable lock designs. It is necessary only that the lock be configured such that, in the locked position, the draw bar 22 will be moved to a position out of engagement with the hammer 20, while in the unlocked position engagement of the hammer 20 by the draw bar 22 will be permitted. Desirable features include tamper resistance and a reduced size which will not interfere with normal operation of the firearm. It is also desirable that the lock be operable without the assistance of external accessories such as keys, which can be lost or misplaced and are difficult to manipulate in an emergency. It further is desirable that dials and other similar lock-opening constructions be avoided, as these cannot be utilized in dark environments and are also difficult to manipulate in an emergency. In a preferred embodiment, the lock includes push buttons 56 which operate to unlock the lock when the buttons have been pressed a proper number of times or in a proper sequential order. Applicant has previously disclosed a number of suitable lock constructions, such as those in Applicant's co-pending application Ser. No. 556,016, filed Jul. 20, 1990, Applicant's co-pending application Ser. No. 202,988, filed Jun. 6, 1988, now U.S. Pat. No. 4,987,693, together with Applicant's co-pending application entitled GRIP LOCK ASSEMBLY, filed concurrently herewith. The disclosures of these applications and patents are hereby incorporated fully by reference.

According to Applicant's other lock constructions, a lock member 60 is movable between locked and unlocked positions upon proper entry of a combination through utilization of push members such as the push buttons 56. A reset button 57 can be provided to initialize the lock for re-entering the combination. According to the present embodiment, a lever member 64 is pivotally connected to the lock assembly about a pivot mounting 66. The lever member 64 is mounted to the lock member 60 by a shaft 68, which can be mounted within a slot 70 formed in the lock member 60. The draw bar engagement portion 54 is provided on the lever member 64 and, upon installation, abuts the draw bar 22.

Figure 2:
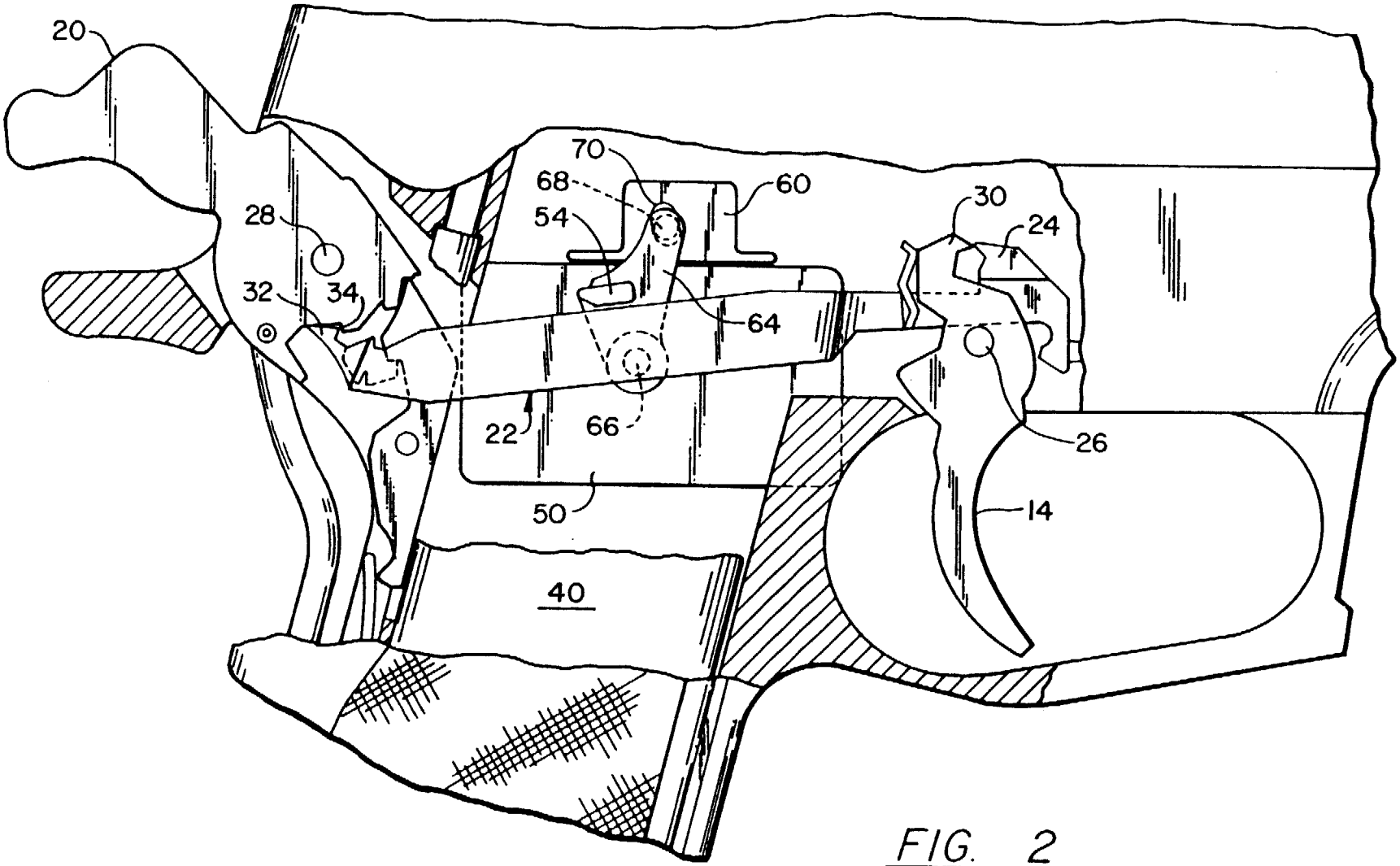
FIG. 2 is a side elevation, partially broken away and partially in phantom, and depicting a first mode of operation.
Figure 3:
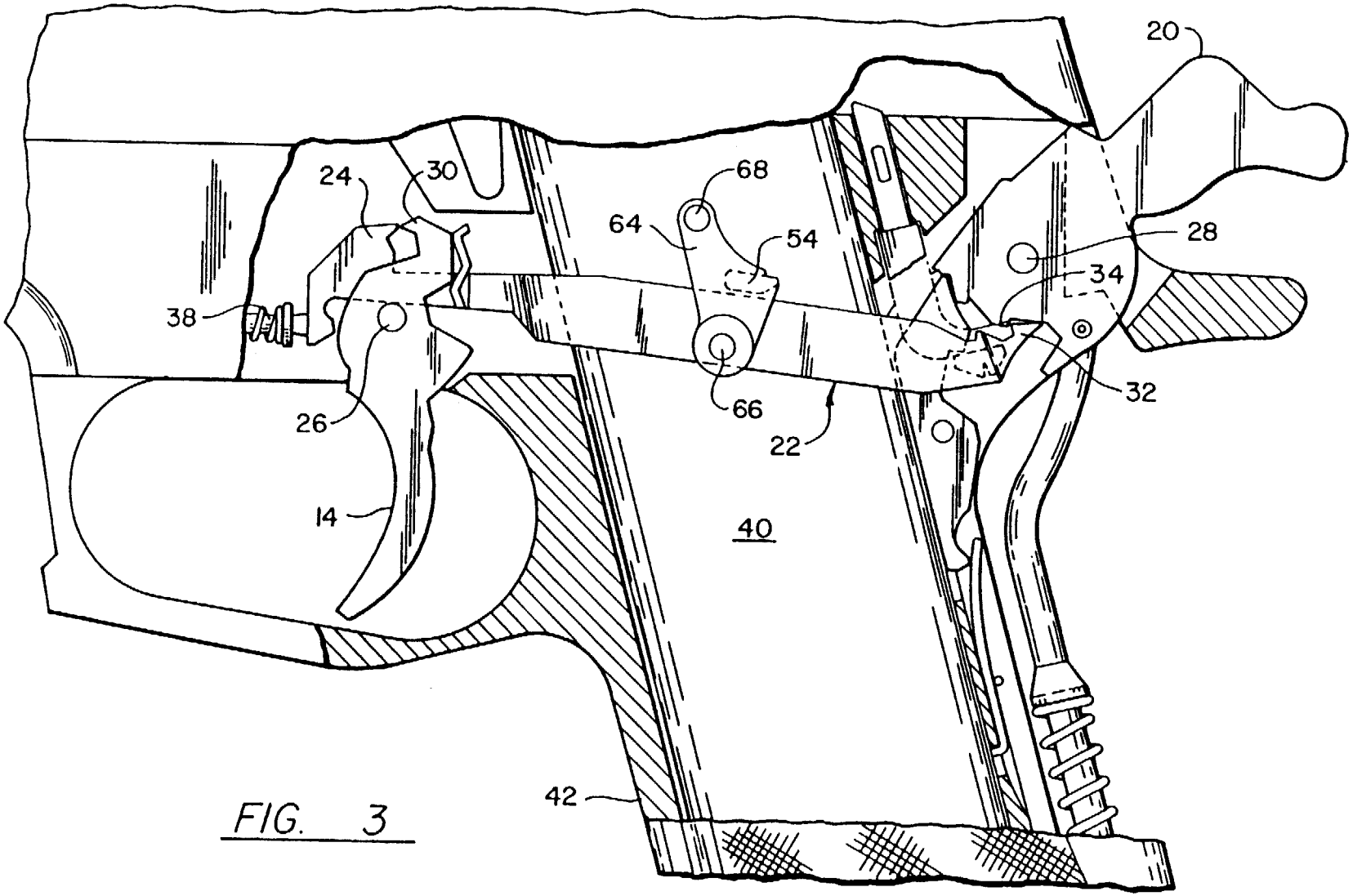
FIG. 3 is a side elevation opposite to that of FIG. 2, partially broken away and partially in phantom, and depicting the first mode of operation.
Figure 4:
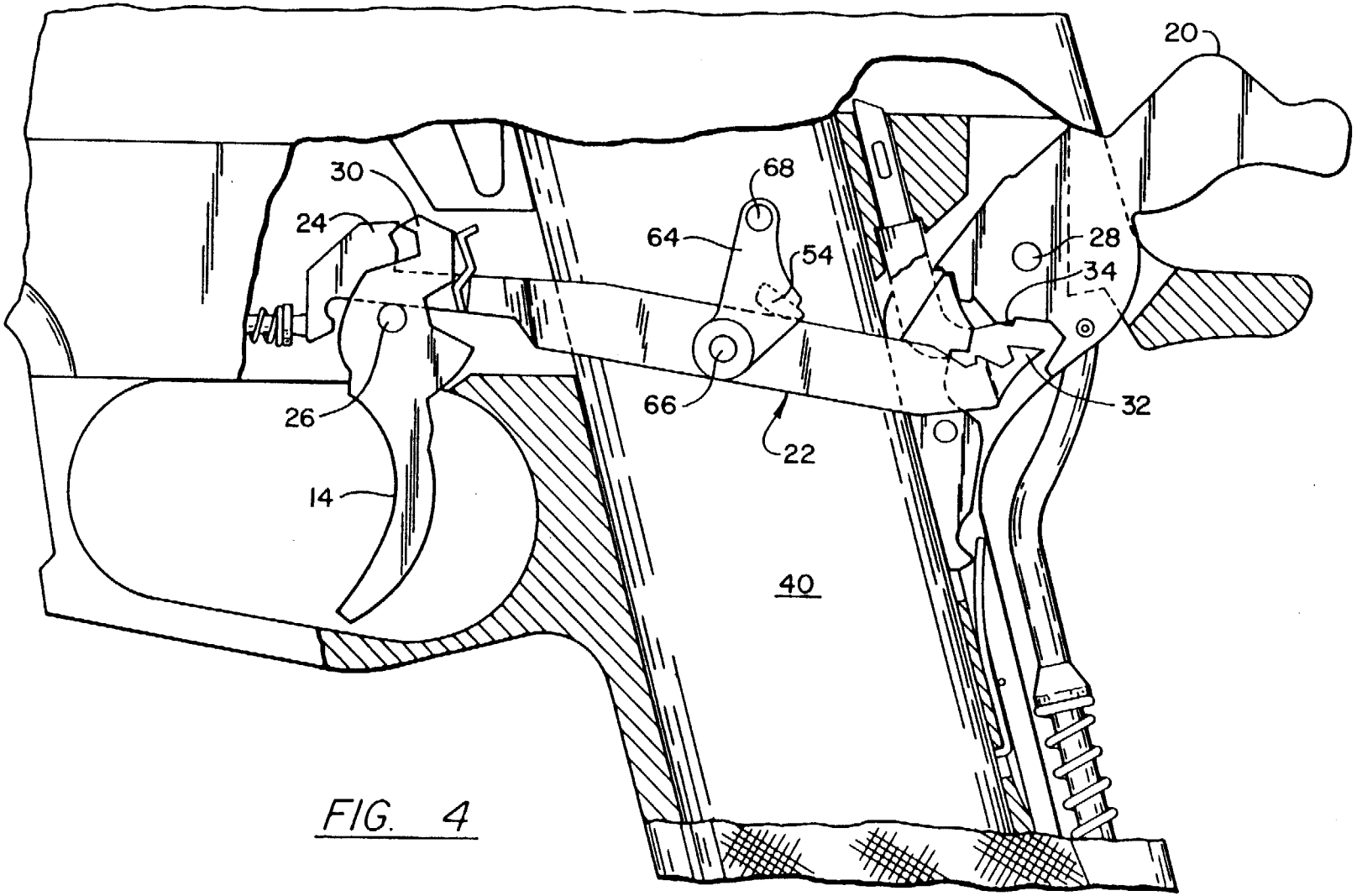
FIG. 4 is a side elevation similar to FIG. 3, and depicting a second mode of operation.

In the unlocked position (FIGS. 2-3), the lock member 60 is in a first position in which the lever member 64 and draw bar engagement portion 54 are in a pivotal position whereby engagement of the hammer 20 by the draw bar 22 is permitted. The lock member 60 can be moved to cause the lever member 64 to pivot about the pivotal mounting 66, which movement will rotate the draw bar engagement portion 54 downward into contact with the draw bar 22, which will move the draw bar 22 out of engagement with the hammer 20, and thereby will prevent operation of the firearm. Upon entry of the appropriate combination or otherwise unlocking the lock, biasing can be provided to drive the lock member 60 to the original position, which will return the lever member 64, draw bar engagement portion 54, and draw bar 22 to the unlocked position of FIGS. 2-3 to quickly render the firearm operable.

The invention provides a tamper-resistant construction which is easily locked against unauthorized use, yet which can readily be activated by unlocking the lock as by entering the appropriate combination. Since the lock operates in conjunction with the existing draw bar in the firearm, the lock is easily installed and will not otherwise affect the normal operation of the weapon.

The lock assembly that has been disclosed is capable of modification both in terms of the construction of the lock, and in the manner in which the draw bar is engaged to render the weapon inoperable. Accordingly, reference should be had to the following claims, rather than to the foregoing specification, to indicate the scope of the invention.

I claim:

1. A lock assembly for a firearm having a draw bar operatively connecting a trigger to a hammer of the firearm, and having an engaged position whereby movement of the trigger will cause operation of the hammer, and a disengaged position in which the hammer is not operatively connected to the trigger by the draw bar, said firearm having a handle frame, said lock assembly comprising:

a lock having lock opening structure;

structure for mounting said lock to said handle frame such that said lock is substantially external to said handle frame and substantially adjacent to said draw bar, and such that said lock opening structure is external to said firearm and accessible to an operator;

said lock further comprising a draw bar engagement portion extending into said firearm and having a locked position in which the draw bar is moved to said disengaged position in which operation of the firearm is prevented, and an unlocked position in which engagement of the hammer by the draw bar is permitted.

2. The firearm lock of claim 1, wherein said lock comprises at least one push member, the push member being operable to unlock the lock upon depression of the push member in accord with a predetermined combination.

3. A lock for a firearm having a draw bar operatively connecting a trigger to a hammer of the firearm, and having an engaged position whereby movement of the trigger will cause operation of the hammer, and a disengaged position in which the hammer is not engaged by the draw bar, said lock comprising:

a lock assembly fixed to the firearm and having a draw bar engagement portion with a locked position in which the draw bar is moved to said disengaged position in which operation of the firearm is prevented, and an unlocked position in which engagement of the hammer by the draw bar is permitted, the lock assembly comprising a movable lock member and a lever member, said lever member being moved by movement of said lock member, said draw bar engagement portion being provided on said lever member in a position substantially abutting said draw bar, movement of said lock member to a locked position causing movement of said lever member and said draw bar engagement portion, and thereby movement of said draw bar out of engagement with said hammer, and movement of said lock member to an unlocked position causing movement of said draw bar engagement portion to a position permitting engagement of said hammer by said draw bar.

4. The firearm lock of claim 3, wherein said lever member has an end pivotally mounted to said lock assembly, and an opposite end pivotally mounted to said lock member.

5. A method for locking a firearm having a draw bar operatively connecting a trigger to a hammer, and having an engaged position whereby movement of the trigger will cause operation of the hammer, and a disengaged position in which the hammer is not operatively connected to the trigger by the draw bar, and firearm having a handle frame, said method comprising the steps of:

installing a lock at a position substantially external to said handle frame of the firearm and substantially adjacent to said draw bar, said lock having lock opening structure external to said firearm and accessible to an operator, the lock having a draw bar engagement portion extending into the firearm and having locked an unlocked positions, the draw bar engagement portion in the locked position being adapted to move and retain the draw bar in said disengaged position, and having an unlocked position in which the draw bar engagement portion is moved to a position permitting said draw bar to move to said engaged position.

6. A handle grip for a firearm, said firearm having a draw bar operatively connecting a trigger to a hammer of the firearm and having an engaged position whereby movement of the trigger will cause operation of the hammer and a disengaged position in which the draw bar does not operatively connect the trigger to the hammer, said handle grip comprising:

a grip assembly adapted to be secured to the firearm;

a lock assembly fixed to the grip assembly and having a draw bar engagement portion positioned such that, upon installation of said grip assembly to the firearm, said draw bar engagement portion will have a locked position in which the draw bar is moved to said disengaged position so as to prevent operation of the firearm, and an unlocked position in which said draw bar can move to said engaged position to permit operation of said firearm.

7. A method for locking a firearm having a handle grip and having a draw bar operatively connecting a trigger to a hammer, said draw bar having an engaged position whereby movement of the trigger will cause operation of the hammer, and a disengaged position in which the hammer is not operatively connected to the trigger by the draw bar, said method comprising the steps of:

replacing said handle grip of the firearm with a replacement handle grip having a lock, the lock having a draw bar engagement portion with locked and unlocked positions, the draw bar engagement portion being positioned substantially adjacent to the draw bar of the firearm upon installation of said replacement handle grip, the draw bar engagement portion in the locked position being adapted to move and retain the draw bar in said disengaged position, and having an unlocked position in which the draw bar engagement portion is moved to a position permitting said draw bar to move to said engaged position.

* * * * *